US009932979B2

(12) United States Patent
Shibata

(10) Patent No.: US 9,932,979 B2
(45) Date of Patent: Apr. 3, 2018

(54) OIL PRESSURE CONTROL DEVICE

(71) Applicant: Okuma Corporation, Niwa-gun, Aichi (JP)

(72) Inventor: Tomohiro Shibata, Aichi (JP)

(73) Assignee: OKUMA CORPORATION (JP)

( * ) Notice: Subject to any disclaimer, the term of this patent is extended or adjusted under 35 U.S.C. 154(b) by 286 days.

(21) Appl. No.: 14/541,202

(22) Filed: Nov. 14, 2014

(65) Prior Publication Data

US 2015/0139815 A1 May 21, 2015

(30) Foreign Application Priority Data

Nov. 15, 2013 (JP) ..... 2013-236606

(51) Int. Cl.
*F04B 49/06* (2006.01)
*F04B 49/20* (2006.01)

(52) U.S. Cl.
CPC ..... *F04B 49/20* (2013.01); *F04B 49/065* (2013.01)

(58) Field of Classification Search
CPC ..... F04B 49/065; F04B 49/20
See application file for complete search history.

(56) References Cited

U.S. PATENT DOCUMENTS 8,162,618 B2 * 4/2012 Nakamura ..... E02F 9/2235 417/212
2002/0052264 A1 * 5/2002 Ui ..... F16H 61/66254 477/45
2009/0097986 A1 * 4/2009 Nakata ..... F04B 49/065 417/44.2
2011/0234144 A1 * 9/2011 Maekawa ..... H02P 23/04 318/702
2014/0371995 A1 * 12/2014 Udagawa ..... E02F 9/123 701/50

(Continued)

FOREIGN PATENT DOCUMENTS

JP H 0780645 8/1995
JP 08-319067 12/1996
JP 2922074 7/1999

(Continued)

OTHER PUBLICATIONS

Japanese Office Action for Japanese Patent Application No. JP 2013-236606. dated May 30, 2017. 7 Pages.

(Continued)

*Primary Examiner* — Jennifer L Norton
(74) *Attorney, Agent, or Firm* — McCarter & English, LLP

(57) ABSTRACT

An oil pressure control device for supplying oil pressure by rotating a hydraulic pump, by means of a motor, comprises an oil pressure sensor; a speed instruction operation unit for outputting a speed instruction value, based on a difference between an oil pressure determination value from the oil pressure sensor and an oil pressure instruction value; a torque instruction value operation unit for calculating a torque instruction value, based on a difference between a speed determination value and the speed instruction value; and a current control unit for controlling a current of the motor, based on the torque instruction value, and adds the load variation compensation speed outputted from the load variation compensation unit and the speed instruction value.

2 Claims, 5 Drawing Sheets

(56) References Cited

U.S. PATENT DOCUMENTS

| | | | | |
|---|---|---|---|---|
| 2015/0139815 | A1* | 5/2015 | Shibata | F04B 49/20<br>417/42 |
| 2016/0084724 | A1* | 3/2016 | Shibata | F04B 49/065<br>417/22 |

FOREIGN PATENT DOCUMENTS

| | | | | |
|---|---|---|---|---|
| JP | 2000-274377 | | 10/2000 | |
| JP | 2001-248566 | | 9/2001 | |
| JP | 2008-232445 | | 10/2008 | |
| JP | 4425253 | | 3/2010 | |
| JP | 2011135677 | A | 7/2011 | |
| WO | WO 2013094616 | A1 * | 6/2013 | E02F 9/123 |

OTHER PUBLICATIONS

Office Action in Chinese Patent Application No. 201410644712.7, dated Nov. 29, 2017, 6 pages.

* cited by examiner

OIL PRESSURE CONTROL DEVICE

CROSS-REFERENCE TO RELATED APPLICATIONS

This application claims priority under 35 U.S.C. § 1.19 (a)-(d) to Japanese Patent Application No. 2013-236606, filed Nov. 15, 2013, the content of which is incorporated herein by reference in its entirety as part of the present disclosure.

BACKGROUND OF THE INVENTION

Field of the Invention

The present invention relates to control of a motor for driving a hydraulic pump in a hydraulic unit for a machine tool.

Description of the Related Art

In a hydraulic unit for supplying oil pressure by rotating a motor connected to a hydraulic pump, it is often a case that the motor is rotated at a constant high speed and the oil pressure is adjusted to a desirable level, by means of an oil pressure relief valve or the like. In this case, as oil from the relief valve is intentionally leaked, high power consumption results with the motor. Further, as the motor is rotated at a high constant speed, a loud noise is emitted. To address the above, various attempts have been made in controlling a motor for driving a hydraulic pump.

FIG. 7 is a block diagram showing a conventional control device of a motor 9 for driving a hydraulic pump. An oil pressure sensor 12 is mounted on a hydraulic circuit to which a hydraulic pump 10 and a load 11 such as a hydraulic cylinder or the like are connected. Using a hydraulic determination value Pd from the oil pressure sensor 12 as a feedback value, a subtractor 2 obtains a hydraulic deviation relative to a hydraulic instruction value Pc outputted from a superior control device 1. Based on the hydraulic deviation, a speed instruction operation unit 3 outputs a speed instruction value Vc through proportional-integral control. Meanwhile, a motor position determination unit 8 is mounted on the motor 9, which is connected to rotate the hydraulic pump, and determines a position determination value. The position determination value is differentiated by a differentiator 13 to output a speed determination value Vd of the motor 9. A subtractor 5 obtains a deviation between the speed instruction value Vc and the speed determination value Vd of the motor 9, and outputs the result as a speed deviation. Based on the speed deviation, a torque instruction operation unit 6 outputs a torque instruction Tc through proportional-integral control. Based on the torque instruction Tc, a current control unit 7 including an inverter flows a current into the motor 9 to control the motor 9.

As the motor 9 is controlled based on the oil pressure determination value Pd determined by the oil pressure sensor 12, it is possible to keep the rotation of the motor 9 to a minimum required rotation and resultantly to reduce power consumption as well as noise.

However, according to the conventional art shown in FIG. 7, in the case where a sharp change in load should occur, response may be delayed. As a result, it takes time to attain a desired oil pressure, which resultantly causes a problem of a longer than expected response time in relation to a load.

SUMMARY OF THE INVENTION

The present invention has been conceived to achieve the above described object, and aims to provide an oil pressure control device for supplying oil pressure by rotating a hydraulic pump, by means of a motor, including an oil pressure sensor placed between the hydraulic pump and a load; a speed instruction operation unit for outputting a speed instruction value, based on a difference between an oil pressure determination value from the oil pressure sensor and an oil pressure instruction value; a torque instruction value operation unit for calculating a torque instruction value, based on a difference between a speed determination value obtained by differentiating a position determination value from a motor position determination unit mounted on the motor and the speed instruction value; and a current control unit for controlling a current of the motor, based on the torque instruction value, the oil pressure control device for adding a load variation compensation speed outputted from the load variation compensation unit to the speed instruction value. The load variation compensation unit may output the load variation compensation speed, based on the oil pressure determination value. Alternatively, the load variation compensation unit may output the load variation compensation speed in response to a signal indicating a load operation pattern outputted from a superior control device. Still alternatively, the load variation compensation unit may output one with a larger value of a load variation compensation speed calculated based on the oil pressure determination value and a load variation compensation speed calculated based on a signal indicating a load operation pattern as the load variation compensation speed.

According to an oil pressure control device according to the present invention, it is possible to reduce a period of time necessary to achieve a desired oil pressure even when a response is delayed due to a sharp change in load, and to resultantly attain a shorter response time of a load, while maintaining low power consumption.

BRIEF DESCRIPTION OF THE DRAWINGS

A preferred embodiment of the present invention will be described in detail by reference to the following figures, wherein.

DETAILED DESCRIPTION OF EMBODIMENTS OF THE INVENTION

Figure 1:
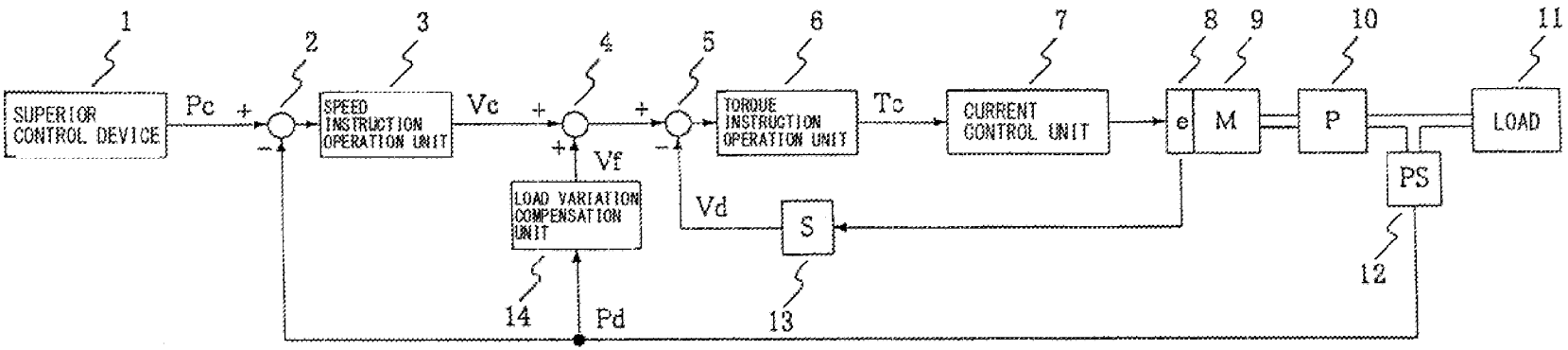
FIG. 1 is a block diagram showing a structure of an oil pressure control device according to a first embodiment of the present invention.
Figure 7:
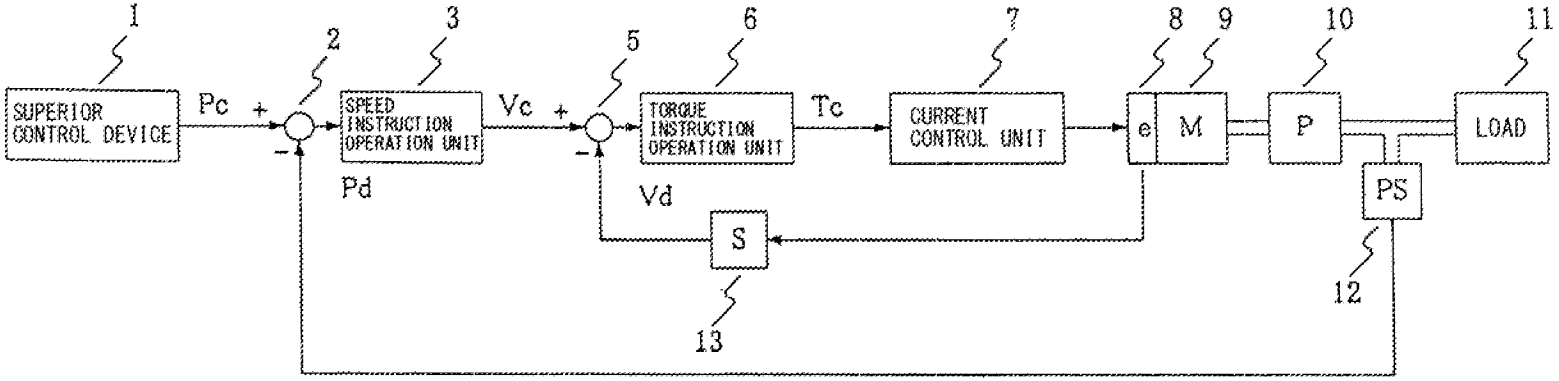
FIG. 7 PRIOR ART
FIG. 7 is a block diagram showing a structure of a conventional motor control device.

An embodiment of the present invention will be described. Components identical to those according to the conventional art is given the same reference numerals, and are not described here. FIG. 1 is a block diagram showing an oil pressure control device according to a first embodiment of the present invention. This embodiment differs from the conventional art shown in FIG. 7 in that a load variation compensation speed Vf is calculated, and that a speed deviation is obtained, based on the sum of the load variation compensation speed Vf and a speed instruction value Vc, and a speed determination value Vd of the motor. That is, a load variation compensation unit 14 outputs the load variation compensation speed Vf, based on the hydraulic determination value Pd determined by the oil pressure sensor 12. An adder 4 adds the load variation compensation speed Vf and the speed instruction value Vc. The subtractor 5 obtains a deviation between the sum and the speed determination value Vd of the motor, and outputs the same as a speed deviation.

Figure 4:
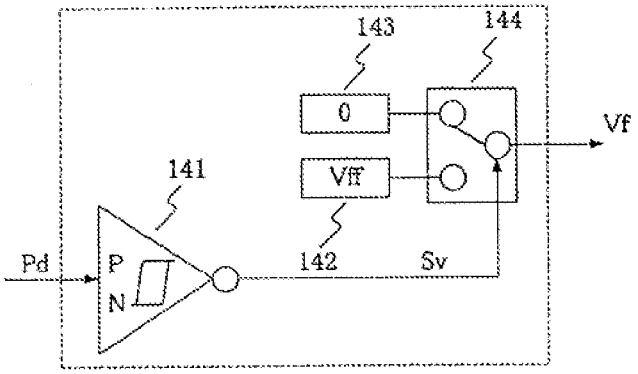
FIG. 4 is a block diagram showing a load variation compensation unit according to the first embodiment of the present invention.

FIG. 4 is a block diagram showing the load variation compensation unit 14 of an oil pressure control device according to the first embodiment. A hysteresis comparator 141 outputs a load variation compensation speed selection signal Sv, based on the oil pressure determination value Pd. A load variation speed selection unit 144 outputs either of a load variation compensation speed 142 and a constant 143 as the load variation compensation speed Vf in response to the load variation compensation speed selection signal Sv.

Specifically, in the case where the oil pressure decreases below a load variation compensation start level N due to load variation, the hysteresis comparator 141 turns on the load variation compensation speed selection signal Sv, and the load variation speed selection unit 144 outputs a load variation compensation speed Vff as the load variation compensation speed Vf. In this case, addition of the load variation compensation speed Vf and an output Vc from the speed instruction operation unit 3 makes a larger speed instruction. As a result, the amount of flow increases, and response of the decreased oil pressure becomes quicker. When the oil pressure thereafter increases beyond the load variation compensation stop level P, the hysteresis comparator 141 turns off the load variation compensation speed selection signal Sv, and the load variation speed selection unit 144 outputs zero as the load variation compensation speed Vf to stop the load variation compensation.

As the motor rotates faster by an amount corresponding to the load variation compensation speed Vf immediately after decrease of the oil pressure due to load variation, the amount of flow from the hydraulic pump increases instantly and, thus, a response time of the oil pressure becomes shorter, as compared to a case with conventional control. The load variation compensation speed Vf is set to a speed corresponding to the highest number of rotations of the hydraulic pump or the tolerable amount of flow of the hydraulic circuit. The load variation compensation start level N is set to a value equal to or greater than the lowest operation pressure of a load. The load variation compensation start level P is set to a value equal to or less than an oil pressure instruction value.

Figure 2:
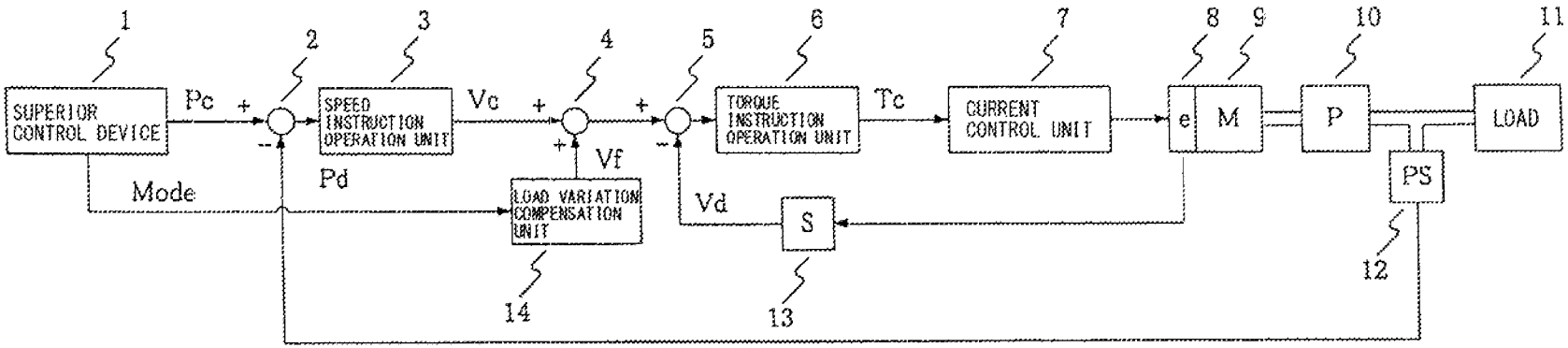
FIG. 2 is a block diagram showing a structure of an oil pressure control device according to a second embodiment of the present invention.
Figure 5:
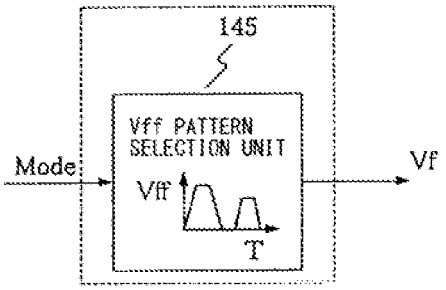
FIG. 5 is a block diagram showing a load variation compensation unit according to the second embodiment of the present invention.

FIG. 2 is a block diagram showing an oil pressure control device according to a second embodiment of the present invention. Components identical to those according to the conventional art are given the same reference numerals, and are not described here. In this oil pressure control device, the load variation compensation unit 14 outputs the load variation compensation speed Vf, based on a load operation mode signal Mode outputted from the superior control device 1. The load operation mode signal Mode is a signal indicating an operation pattern of a load. FIG. 5 is a block diagram of the load variation compensation unit 14 of the oil pressure control device according to the second embodiment. A Vff pattern selection unit 145 outputs a load variation compensation speed Vff pattern prepared in advance in accordance with each of the operation modes as the load variation compensation speed Vf.

Specifically, load variation is predictable based on an operation pattern of a load. As a load variation compensation speed Vff pattern is outputted in response to a load operation mode signal Mode at the same time of starting operation of a load, a larger speed instruction is attained simultaneously with decrease of the oil pressure. This results in an increase of the amount of flow, only a small decrease of oil pressure, and a quicker response of oil pressure. Further, as the motor rotates faster by an amount corresponding to the load variation compensation speed Vf, prepared in advance in accordance with a load variation that differs for every operation mode, a stabilized pressure can be attained at the time of operation of a load, as well as a shorter response time of oil pressure. In addition, preparation of a plurality of load variation compensation speed Vff patterns makes it possible to respond to a variety of load variations.

Figure 3:
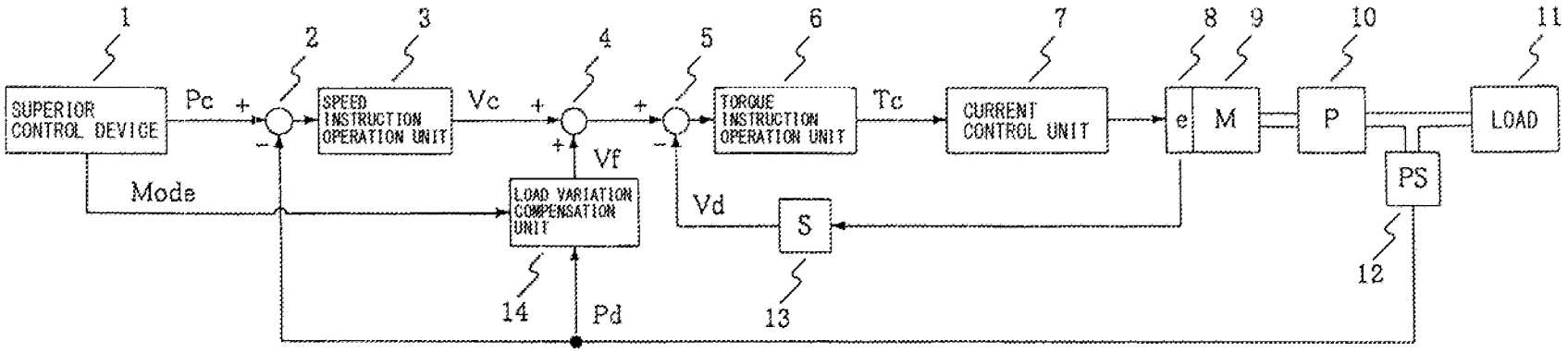
FIG. 3 is a block diagram showing a structure of an oil pressure control device according to a third embodiment of the present invention.

FIG. 3 is a block diagram showing an oil pressure control device according to a third embodiment of the present invention. Components identical to those according to the conventional art are given the same reference numerals, and are not described here. In this oil pressure control device, the load variation compensation unit 14 outputs the load variation compensation speed Vf, based on the oil pressure determination value Pd and the load operation mode signal Mode outputted from the superior control device 1.

Figure 6:
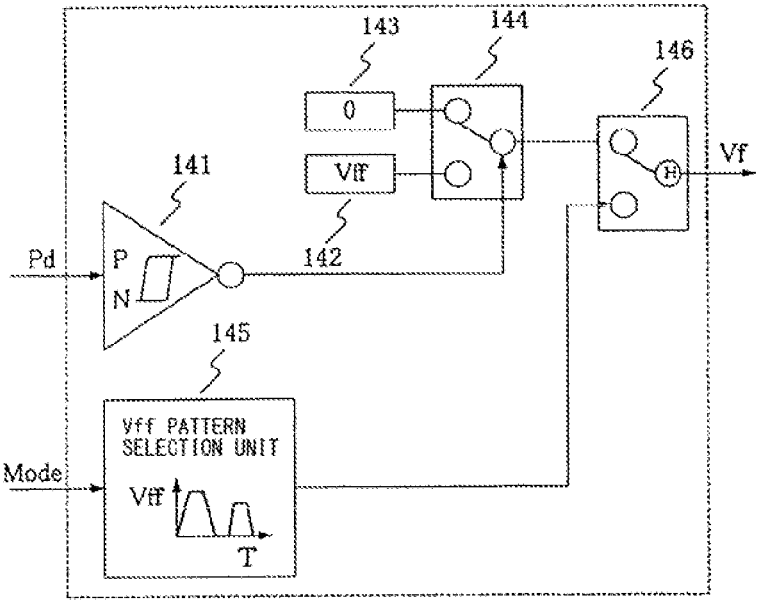
FIG. 6 is a block diagram showing a load variation compensation unit according to the third embodiment of the present invention.

FIG. 6 is a block diagram showing the load variation compensation unit 14 of the oil pressure control device according to the third embodiment of the present invention. The load variation speed selection unit 146 outputs one with a larger value of an output from the load variation speed selection unit 144 and an output from the Vff pattern selection unit 145 as the load variation compensation speed Vf.

Specifically, as a load variation compensation speed Vff pattern is outputted in response to the load operation mode signal Mode, a larger speed instruction is attained simultaneously with decrease of the oil pressure, which results in an increase of the amount of flow, only a small decrease of oil pressure, and a quicker response of oil pressure. Further, even when an unexpected deviation should be caused to an expected load variation and the oil pressure thus decreases below the load variation compensation start level N, as the motor rotates faster by an amount corresponding to the load variation compensation speed Vf immediately after decrease of the oil pressure, the amount of flow from the hydraulic pump increases instantly, and a response time of the oil pressure becomes shorter, as compared to a case with conventional control.

What is claimed is:

1. An oil pressure control device for supplying oil pressure by rotating a hydraulic pump, using a motor, comprising:

an oil pressure sensor operatively placed between the hydraulic pump and a load, and configured to determine an oil pressure;

a motor position determination unit mounted on the motor determines a speed of the motor;

a speed instruction operation unit calculates an oil pressure difference by subtracting an oil pressure determination value determined by the oil pressure sensor from an oil pressure instruction value, and outputs a speed instruction value, based on the oil pressure difference;

a load variation compensation unit outputs a load variation compensation speed for compensating the speed instruction value outputted from the speed instruction operation unit, depending on variation of the oil pressure determination value;

a differentiation unit differentiates a position determination value from the motor position determination unit and outputs a speed determination value;

an addition unit calculates a compensated speed instruction value by adding the speed instruction value from the speed instruction operation unit and the load variation compensation speed from the load variation compensation unit;

a torque instruction value operation unit calculates a speed difference by subtracting the speed determination value from the compensated speed instruction value, and calculates a torque instruction value, based on the speed difference; and a current control unit controls a current of the motor, based on the torque instruction value;

wherein the load variation compensation unit sets the load variation compensation speed to be larger, when the oil pressure is lower than a predetermined value, than a value to which the load variation compensation speed is set when the oil pressure is higher than another predetermined value.

2. The oil pressure control device according to claim 1, wherein the load variation compensation unit starts outputting a predefined compensation value as the load variation compensation speed at a timing when the oil pressure determination value becomes lower than a load variation compensation start level, and starts outputting zero as the load variation compensation speed at a timing when the oil pressure determination value becomes higher than a load variation compensation stop level.

* * * * *